US007802876B2

(12) United States Patent
Okawa et al.

(10) Patent No.: US 7,802,876 B2
(45) Date of Patent: Sep. 28, 2010

(54) ACTUATOR UNIT AND MANUFACTURING METHOD THEREOF, AND LIQUID EJECTION HEAD

(75) Inventors: Yasuo Okawa, Nagoya (JP); Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 267 days.

(21) Appl. No.: 12/165,386

(22) Filed: Jun. 30, 2008

(65) Prior Publication Data

US 2009/0002462 A1 Jan. 1, 2009

(30) Foreign Application Priority Data

Jun. 29, 2007 (JP) ..... 2007-171356

(51) Int. Cl.
*B41J 2/045* (2006.01)

(52) U.S. Cl. ..... 347/72

(58) Field of Classification Search ..... 347/72, 347/68–71; 400/124.14, 124.16; 310/311, 310/324; 29/25.35, 890.1
See application file for complete search history.

(56) References Cited

U.S. PATENT DOCUMENTS

| | | | | |
|---|---|---|---|---|
| 5,402,159 | A | 3/1995 | Takahashi et al. | |
| 6,964,472 | B2 * | 11/2005 | Takagi et al. | 347/72 |
| 7,083,270 | B2 * | 8/2006 | Torii et al. | 347/68 |
| 7,213,910 | B2 * | 5/2007 | Chikamoto | 347/68 |
| 7,305,764 | B2 * | 12/2007 | Kitahara | 29/890.1 |
| 7,374,276 | B2 | 5/2008 | Taira et al. | |
| 2002/0051042 | A1 * | 5/2002 | Takagi et al. | 347/72 |
| 2006/0012649 | A1 | 1/2006 | Sakaida | |

FOREIGN PATENT DOCUMENTS

| | | | |
|---|---|---|---|
| JP | H04-341852 | A | 11/1992 |
| JP | 2001-038899 | A | 2/2001 |
| JP | 2005-022117 | A | 1/2005 |
| JP | 2005-199227 | A | 7/2005 |
| JP | 2006-027099 | A | 2/2006 |

OTHER PUBLICATIONS

Japan Patent Office; Notice of Reasons for Rejection in Japanese Patent Application No. 2007-171356 (counterpart to the above U.S. patent application) mailed Apr. 21, 2009.

* cited by examiner

*Primary Examiner*—K. Feggins
(74) *Attorney, Agent, or Firm*—Baker Botts L.L.P.

(57) ABSTRACT

An actuator unit for applying pressure to liquid in each of pressure chambers formed in a passage unit includes a piezoelectric layer; a common electrode formed on one surface of the piezoelectric layer to be positioned over the pressure chambers; and electric field blocking layers formed on an opposite surface of the piezoelectric layer from the one surface to be opposed to the common electrode and outside regions of the respective pressure chambers. Each electric field blocking layer is porous and lower in dielectric constant than the piezoelectric layer. The actuator unit further includes lands each positioned to sandwich an electric field blocking layer between the land and the piezoelectric layer; and individual electrodes formed on the opposite surface to be opposed to the respective pressure chambers and the common electrode and neighbor the respective electric field blocking layers. Each individual electrode is electrically connected to the corresponding land.

14 Claims, 10 Drawing Sheets

ACTUATOR UNIT AND MANUFACTURING METHOD THEREOF, AND LIQUID EJECTION HEAD

The present application claims priority from Japanese Patent Application No. 2007-171356, which was filed on Jun. 29, 2007, the disclosure of which is herein incorporated by reference in its entirety.

BACKGROUND OF THE INVENTION

1. Field of the Invention

The present invention relates to an actuator unit to be used in a liquid ejection head that ejects liquid, a manufacturing method of the actuator unit, and the liquid ejection head.

2. Description of Related Art

In an inkjet head as a liquid ejection head of an inkjet printer, ink supplied from an ink tank is distributed to a plurality of pressure chambers. Pulsed pressure is then selectively applied to the pressure chambers to eject ink from nozzles. As a means for selectively applying pressure to ink in pressure chambers, an actuator unit can be used in which a plurality of piezoelectric layers made of piezoelectric ceramic are put in layers.

For example, Japanese Patent Unexamined Publication No. Hei 4-341852 discloses an inkjet head including an actuator unit in which a plurality of continuous flat piezoelectric sheets are put in layers over a plurality of pressure chambers. At least one piezoelectric sheet or layer is sandwiched by a common electrode positioned over the pressure chambers and being kept at the ground potential, and a plurality of individual electrodes positioned so as to be opposed to the respective pressure chambers. In this inkjet head, when an individual electrode cooperating with the common electrode to sandwich a portion of the piezoelectric sheet that has been polarized along its thickness is put at a different potential from the common electrode, an external electric field is applied to the portion of the piezoelectric sheet along its polarization. Thereby, the portion of the piezoelectric sheet increases or decreases in its thickness by the so-called longitudinal piezoelectric effect. In this case, the portion of the piezoelectric sheet sandwiched by the individual and common electrodes serves as an active portion to be deformed by the piezoelectric effect when an external electric field is applied. The corresponding pressure chamber is thereby changed in its volume so that ink is ejected toward a recording medium from a nozzle connected to the pressure chamber.

SUMMARY OF THE INVENTION

Recently in such an inkjet head as described above, pressure chambers are arranged at a higher density in order to meet the requirements of an increase in image resolution and higher-speed printing. However, this brings about a problem of so-called structural crosstalk in which deformation of an active portion opposed to a pressure chamber causes deformation of a portion of the piezoelectric sheet opposed to a neighboring pressure chamber so that the quantity of ink ejection is increased or decreased from its desired quantity. In particular, as for a land formed as an extension from each individual electrode for inputting a voltage to the individual electrode through the land, which land is positioned so as to be opposed to a region of the piezoelectric sheet outside the corresponding pressure chamber, that is, so as not to be opposed to the corresponding pressure chamber, such a land was conventionally considered not to be a factor of occurrence of crosstalk because it does not directly drive the corresponding pressure chamber. However, the inventors of the present invention have found that such a land can be a factor of occurrence of crosstalk because the portion of the piezoelectric sheet sandwiched by the land and the common electrode is also deformed by an applied external electric field so as to deform a portion of the piezoelectric sheet around the land. The inventors of the present invention have further found that such a land has no measurable effect because the land is positioned closer to a neighboring pressure chamber than the corresponding individual electrode. When such structural crosstalk occurs, the quantity of deformation of the piezoelectric sheet overlapping each pressure chamber differs from the desired quantity so that ink ejection characteristics such as ink droplet velocity and ink droplet volume vary. This reduces printing quality.

An object of the present invention is to provide an actuator unit, a manufacturing method of the unit, and a liquid ejection head, wherein structural crosstalk can be reduced.

According to an aspect of the present invention, there is provided an actuator unit to be fixed to a surface of a passage unit in which liquid passages including a plurality of pressure chambers are formed. The actuator unit serves to apply pressure to liquid in each pressure chamber. The actuator unit comprises a piezoelectric layer; a common electrode formed on one surface of the piezoelectric layer so as to be positioned over the plurality of pressure chambers; and a plurality of electric field blocking layers formed on an opposite surface of the piezoelectric layer from the one surface so as to be opposed to the common electrode and outside regions of the respective pressure chambers. The electric field blocking layers are arranged on the opposite surface of the piezoelectric layer so as to be distant from each other in the plane of the opposite surface. Each electric field blocking layer has one or more holes. Each electric field blocking layer is lower in dielectric constant than the piezoelectric layer. The actuator unit further comprises a plurality of lands each of which is positioned so as to cooperate with the piezoelectric layer to sandwich an electric field blocking layer; and a plurality of individual electrodes formed on the opposite surface of the piezoelectric layer so as to be opposed to the respective pressure chambers and the common electrode and neighbor the respective electric field blocking layers. Each individual electrode is electrically connected to the corresponding land.

According to the above aspect of the invention, the plurality of electric field blocking layers each having one or more holes are interposed between the piezoelectric layer and the plurality of lands. Thus, when a plurality of lands and a plurality of individual electrodes and the common electrode are put at predetermined potentials, an external electric field is hard to be applied to the portion of the piezoelectric layer opposed to each land. Therefore, the portion of the piezoelectric layer is hard to be deformed. This suppresses so-called structural crosstalk in which the deformation of the portion of the piezoelectric layer spreads around the portion. In addition, because each electric field blocking layer has one or more holes, its dielectric constant is lower than that of the piezoelectric layer. This expands the scope of selection of the raw material of the base material of the electric field blocking layer.

According to another aspect of the invention, there is provided a manufacturing method of an actuator unit to be fixed to a surface of a passage unit in which liquid passages including a plurality of pressure chambers are formed. The actuator unit serves to apply pressure to liquid in each pressure chamber. The method comprises a common electrode forming step of forming a common electrode on one surface of a piezoelectric layer. The common electrode has its size capable of covering the plurality of pressure chambers. The method further comprises an electric field blocking layer forming step of forming a plurality of electric field blocking layers respectively in a plurality of first regions on an opposite surface of the piezoelectric layer from the one surface. The first regions are opposed to the common electrode. The first regions are arranged on the opposite surface of the piezoelectric layer so as to be distant from each other in the plane of the opposite surface. Each electric field blocking layer has one or more holes. Each electric field blocking layer is lower in dielectric constant than the piezoelectric layer. The method further comprises an individual electrode forming step of forming a plurality of individual electrodes respectively in a plurality of second regions on the opposite surface of the piezoelectric layer. The second regions are opposed to the common electrode and neighbor the respective electric field blocking layers. Each individual electrode is further formed on a surface of the electric field blocking layer neighboring the corresponding second region. The method further comprises a land forming step of forming a plurality of lands in regions of the respective individual electrodes opposed to the respective electric field blocking layers.

According to the above aspect of the invention, the plurality of electric field blocking layers each having one or more holes can be formed between the piezoelectric layer and the plurality of lands. Thus, an actuator unit having the following effect can be manufactured. That is, when a plurality of lands and a plurality of individual electrodes and the common electrode are put at predetermined potentials, an external electric field is hard to be applied to the portion of the piezoelectric layer opposed to each land. Therefore, the portion of the piezoelectric layer is hard to be deformed. This suppresses so-called structural crosstalk in which the deformation of the portion of the piezoelectric layer spreads around the portion.

According to still another aspect of the present invention, a liquid ejection head comprises a passage unit in which a plurality of pressure chambers each connected to an ejection port are arranged adjacent to each other in a matrix along a surface of the passage unit; and an actuator unit fixed to the surface of the passage unit for changing the volume of each pressure chamber. The actuator unit has a layered structure in which a common electrode positioned over the plurality of pressure chambers, a piezoelectric layer capable of expanding and contracting by an externally applied electric field, and a plurality of individual electrodes positioned so as to be opposed to the respective pressure chambers are put in layers in this order on a vibrating plate that covers the plurality of pressure chambers. The piezoelectric layer has been polarized along its thickness and can expand or contract perpendicularly to its thickness to change the volumes of pressure chambers when an external electric field is applied along its thickness. Each individual electrode has on an upper surface of the piezoelectric layer a main electrode portion opposed to the corresponding pressure chamber, and an outside electrode portion opposed to an outside region of the pressure chamber. Both of the main and outside electrode portions are opposed to the common electrode. A plurality of electric field blocking layers lower in dielectric constant than the piezoelectric layer are positioned on the upper surface of the piezoelectric layer so as to be opposed the outside regions of the respective pressure chambers and the common electrode. The electric field blocking layers are sandwiched between the piezoelectric layer and a plurality of lands that are electrically connected to the outside electrode portions of the respective individual electrodes so that drive signals can be supplied to the respective individual electrodes through the lands. Each electric field blocking layer is a porous layer having therein at least one hole.

According to the above aspect of the invention, a porous electric field blocking layer is interposed between each land and the piezoelectric layer. Thus, when a plurality of lands and a plurality of individual electrodes and the common electrode are put at predetermined potentials, an external electric field is hard to be applied to the portion of the piezoelectric layer opposed to each land. Therefore, the portion of the piezoelectric layer is hard to be deformed. This suppresses so-called structural crosstalk in which the deformation of the portion of the piezoelectric layer spreads around the portion. As a result, liquid ejection characteristics become stable. In addition, because each electric field blocking layer is porous, its dielectric constant is lower than that of the piezoelectric layer. This expands the scope of selection of the raw material of the base material of the electric field blocking layer.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
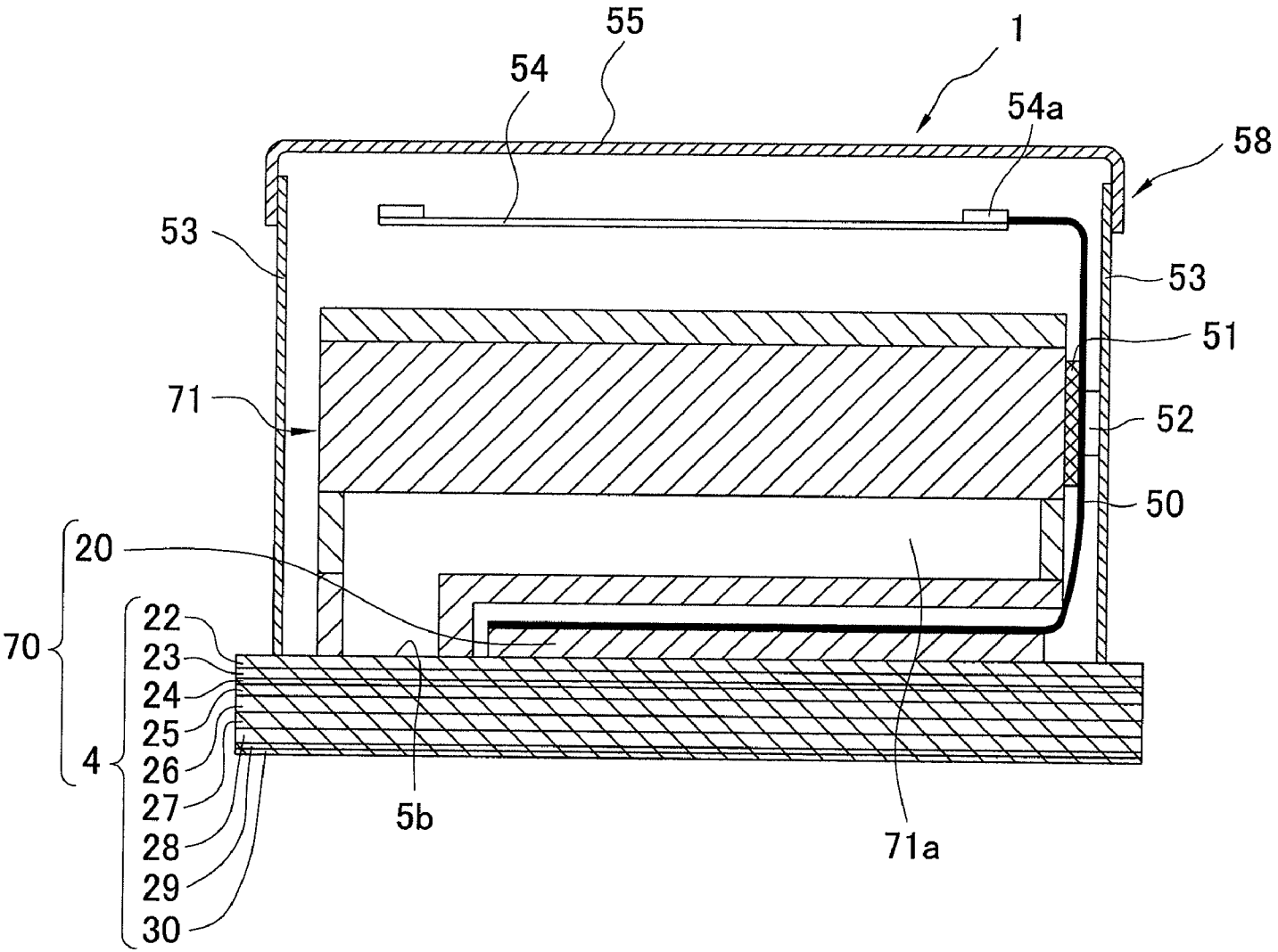
FIG. 1 is a vertical sectional view of an inkjet head according to a first embodiment of the present invention.

An inkjet head according to a first embodiment of the present invention will be described. As shown in FIG. 1, the inkjet head 1 as a liquid ejection head includes a head main body 70 that ejects ink; a reservoir unit 71 positioned on an upper face of the head main body 70; flexible printed circuits (FPCs) 50 electrically connected to the head main body 70; and a control substrate 54 electrically connected to the FPCs 50. Of them, the head main body 70 is made up of a passage unit 4 in which ink passages are formed; and actuator units 20. The reservoir unit 71 supplies ink to the passage unit 4. Each FPC 50 is connected at its one end to an upper face of the corresponding actuator unit 20. In the middle of each FPC 50, a driver IC 52 is provided for supplying a drive signal.

Figure 2:
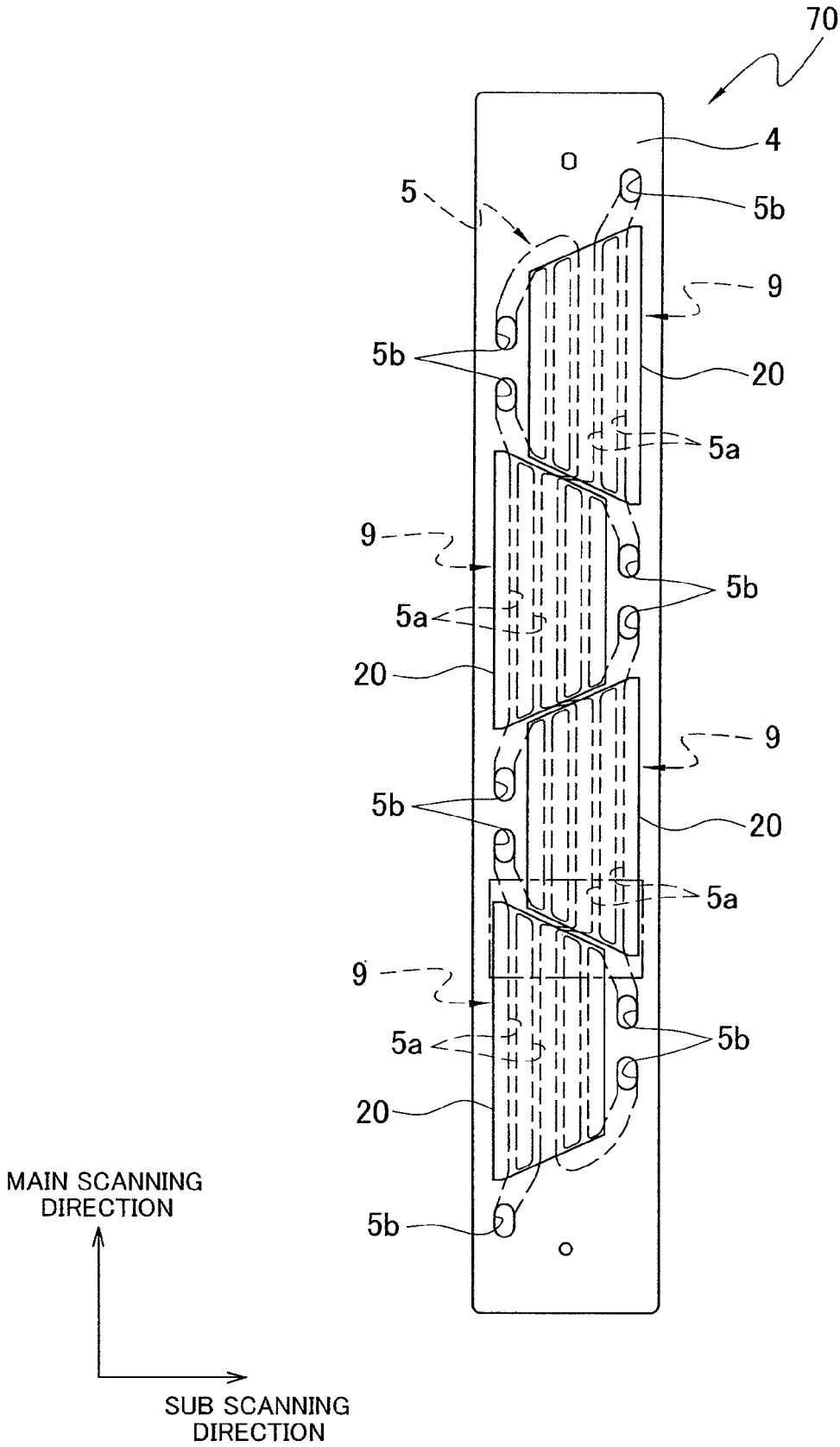
FIG. 2 is a plan view of a head main body shown in FIG. 1.

As shown in FIG. 2, the head main body 70 has at the upper face of the passage unit 4 ten ink supply ports 5*b* connected to the internal ink passages. As will be described later, each ink passage includes a pressure chamber 10 formed in the upper face of the passage unit 4, and a nozzle connected to the pressure chamber 10 for ejecting ink. Each nozzle has an ejection port 8. On the upper face of the passage unit 4, not-shown filters cover the respective ink supply ports 5*b* to prevent foreign substances from being mixed in ink.

The control substrate 54 is horizontally positioned over the reservoir unit 71. The other end of each FPC 50 is connected to the control substrate 54 through a connector 54*a*. Following an instruction from the control substrate 54, the driver IC 52 of each FPC 50 supplies a drive signal to the corresponding actuator unit 20 via wires on the FPC 50.

The reservoir unit 71 is positioned over the head main body 70. The reservoir unit 71 has therein an ink reservoir 71*a* in which ink is stored. The ink reservoir 71*a* is connected to the ink supply ports 5*b* of the passage unit 4. Thus, ink in the ink reservoir 71*a* is supplied to the ink passages in the passage unit 4 via the ink supply ports 5*b*.

The actuator units 20, the reservoir unit 71, the control substrate 54, the FPCs 50, and so on, are covered by a cover member 58 constituted by a side cover 53 and a head cover 55, so as to prevent externally scattered ink from entering. The cover member 58 is made of metal. Elastic sponges 51 are positioned on a side face of the reservoir unit 71. As shown in FIG. 1, the driver IC 52 of each FPC 50 is positioned so as to be just opposed to the corresponding sponge 51, which is pressing the driver IC 52 onto an inner surface of the side cover 53. Therefore, heats generated in each driver IC 52 are transmitted to the side cover 53 and then the head cover 55 to externally radiate. That is, the heats quickly externally radiate through the cover member 58 made of metal. Thus, in this embodiment, the cover member 58 also serves as a heat sink.

Figure 3:
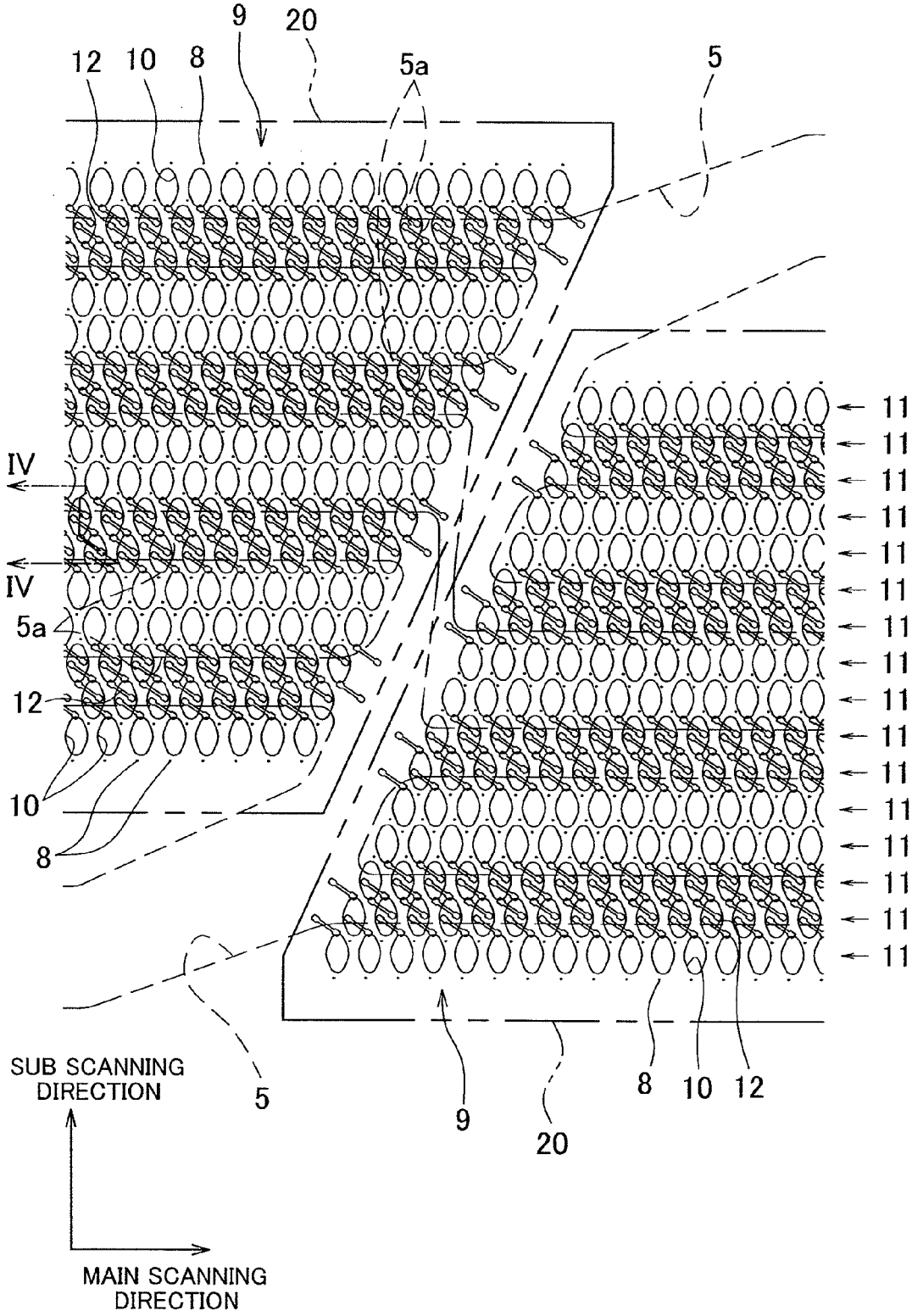
FIG. 3 is an enlarged view of a region enclosed with an alternate long and short dash line in FIG. 2.

Next, the head main body 70 will be described in detail. As shown in FIG. 2, in a plan view, the passage unit 4 has a rectangular shape extending in a main scanning direction. In the passage unit 4, as shown in FIG. 3, a plurality of pressure chambers 10 are two-dimensionally arranged in a matrix. In a plan view, each pressure chamber 10 has a substantially rhombic shape whose corners are rounded. A plurality of pressure chambers 10 constitute a pressure chamber group 9, as shown in FIG. 3. As shown in FIG. 2, four trapezoidal actuator units 20 are bonded to the upper face of the passage unit 4 to be zigzag in two rows so as to correspond to the arrangement of the pressure chamber groups 9.

A region of the lower face of the passage unit 4 opposite to the region where each actuator unit 20 is bonded is formed into an ink ejection region where a plurality of ejection ports 8 are positioned. Each ink ejection region is trapezoidal like each actuator unit 20. The ejection ports 8 are arranged in a matrix like pressure chambers 10, and constitute a plurality of ejection port rows. Of the ink ejection regions, in the regions whose parallel opposite sides extend in lines with each other longitudinally of the passage unit 4, the ejection port rows corresponding to each other extend longitudinally in a line. That is, in each pair of ink ejection regions positioned to sandwich another ink ejection region between them, when viewed longitudinally of the passage unit 4, each ejection port row is on the same straight line as the corresponding ejection port row.

In this embodiment, sixteen pressure chamber rows 11 in each of which a plurality of pressure chambers 10 are arranged at regular intervals longitudinally of the passage unit 4, that is, in a main scanning direction, are arranged parallel to one another perpendicularly to the length of the passage unit 4, that is, in a sub scanning direction. In accordance with the profile of each actuator unit 20, the plurality of pressure chambers 10 included in each pressure chamber row 11 gradually decreases from the long side toward the short side of the actuator unit 20.

The pressure chambers 10 are arranged in a matrix so that an acute portion of each pressure chamber is positioned in between acute portions of two pressure chambers belonging to a neighboring pressure chamber row 11. The ejection ports 8 are also arranged like the pressure chambers 10. This enables image formation at a resolution of 600 dpi as a whole.

In the passage unit 4, as shown in FIGS. 2 and 3, there are formed manifold channels 5 connected to the respective ink supply port 5*b*; and sub-manifold channels 5*a* that branch from each manifold channel 5. Each manifold channel 5 extends along an oblique side of the corresponding actuator unit 20 to intersect with a longitudinal axis of the passage unit 4. In a region sandwiched by two actuator units 20, one manifold channel 5 is shared by the neighboring actuator units 20, and sub-manifold channels 5*a* branch from both sides of the manifold channel 5. Each sub-manifold channel 5*a* extends longitudinally of the passage unit 4 in a region opposed to each trapezoidal ink ejection region. Both ends of each sub-manifold channel 5*a* are connected to the corresponding manifold channel 5 at an oblique side of the corresponding ink ejection region. Thus, each sub-manifold channel 5*a* forms a closed loop in the corresponding ink ejection region.

Each ejection port 8 is connected to a sub-manifold channel 5*a* through a pressure chamber 10 and an aperture 12 as a restricted passage. In FIG. 3, for the purpose of easy understanding, each actuator unit 20 is shown by an alternate long and two short dashes line. Further, pressure chambers 10, apertures 12, and ejection ports 8 are shown by solid lines though they should be shown by broken lines because they are positioned behind each actuator unit 20.

Figure 4:
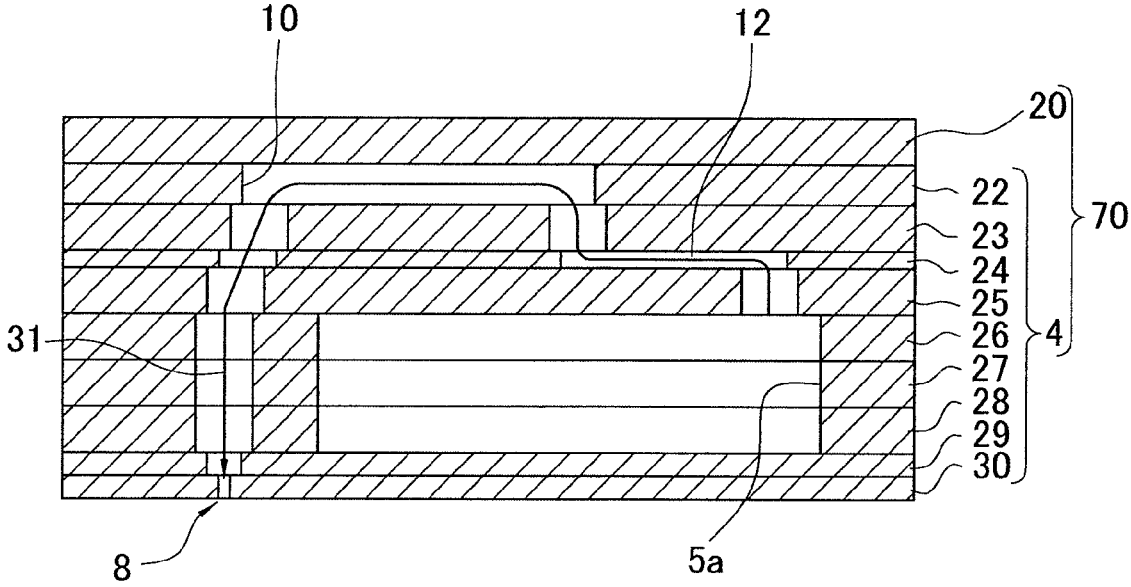
FIG. 4 is a sectional view taken along line IV-IV in FIG. 3.

Next, a sectional structure of the head main body 70 will be described. FIG. 4 is a sectional view taken along line IV-IV in FIG. 3. As shown in FIG. 4, the passage unit 4 has a layered structure in which nine metal plates made of stainless steel are put in layers, which are, in the order from the uppermost layer, a cavity plate 22; a base plate 23; an aperture plate 24; a supply plate 25; manifold plates 26, 27, and 28; a cover plate 29; and a nozzle plate 30. Each of the plates 22 to 30 has an extended rectangular shape in a plan view. Each actuator unit 20 is bonded onto the cavity plate 22.

In the cavity plate 22, there are formed through holes corresponding to respective ink supply ports 5*b*, and a plurality of substantially rhombic through holes corresponding to respective pressure chambers 10. In the base plate 23, there are formed a connection hole between each pressure chamber 10 and the corresponding aperture 12; a connection hole between each pressure chamber 10 and the corresponding ejection port 8; and connection holes between ink supply ports 5*b* and manifold channels 5. In the aperture plate 23, there are formed a through hole as an aperture 12 corresponding to each pressure chamber 10; a connection hole between each pressure chamber 10 and the corresponding ejection port 8; and connection holes between ink supply ports 5*b* and manifold channels 5. In the supply plate 25, there are formed a connection hole between an aperture 12 and a sub-manifold channel 5*a* corresponding to each pressure chamber 10; and a connection hole between each pressure chamber 10 and the corresponding ejection port 8.

In the manifold plates 26 to 28, there are formed connection holes between each pressure chamber 10 and the corresponding ejection port 8; and through holes that cooperate with each other in layers to form each of manifold channels 5 and sub-manifold channels 5*a*. In the cover plate 29, there is formed a connection hole between each pressure chamber 10 and the corresponding ejection port 8. In the nozzle plate 30, there is formed a hole opposed to an ejection port 8 corresponding to each pressure chamber 10.

The above nine plates 22 to 30 are put in layers with being positioned to each other to form the passage unit 4. The plates 22 to 30 are fixed with an adhesive. In the passage unit 4, individual ink passages 31 as shown in FIG. 4 are formed as liquid passages. Each individual ink passage 31 leads from an outlet of a sub-manifold channel 5*a* to an ejection port 8.

Each through hole formed in the cavity plate 22 to serve as a pressure chamber 10 is covered with the base plate 23 as shown in FIG. 4 so that an opening of the pressure chamber 10 is formed as a recess in the upper face of the passage unit 4. An actuator unit 20 is bonded to the upper face of the passage unit 4 to cover the opening. Each pressure chamber 10 is thus defined.

Figure 5A:
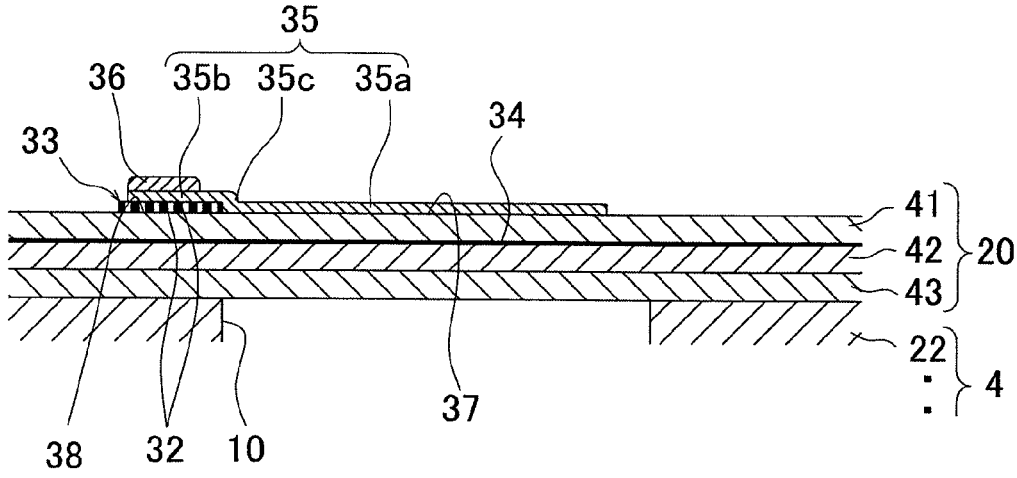
FIG. 5A is a partial sectional view of an actuator unit.
Figure 5B:
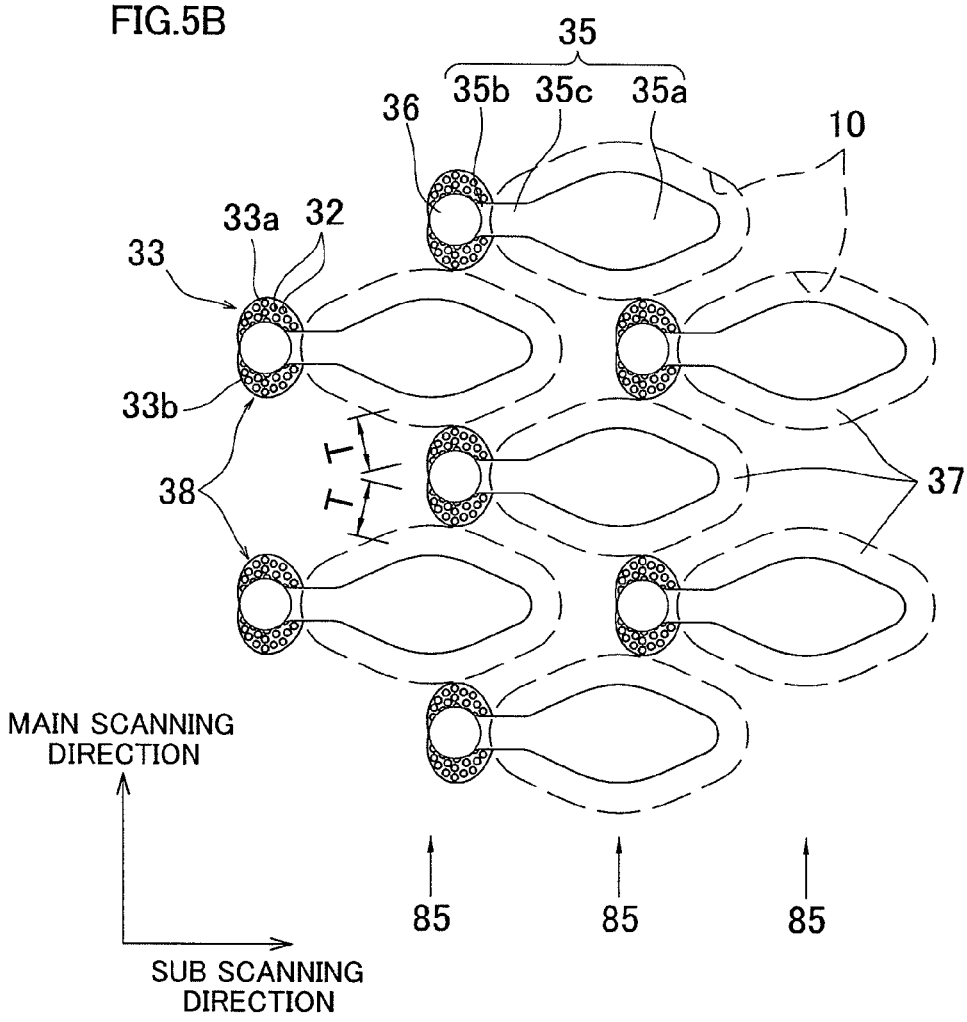
FIG. 5B is a partial plan view of the actuator unit.

Next, the actuator units 20 will be described with reference to FIGS. 5A and 5B. As shown in FIG. 5A, each actuator unit 20 includes three piezoelectric layers 41 to 43 having substantially the same thickness of about 15 micrometers; a plurality of individual electrodes 35 formed on the upper face of the piezoelectric layer 41; and a common electrode 34 formed between the piezoelectric layers 41 and 42, that is, on the lower face of the piezoelectric layer 41. In other words, the actuator unit 20 is constructed by put the common electrode 34, the piezoelectric layer 41, and the individual electrodes 35 in layers in this order on the piezoelectric layers 42 and 43 that serve as a vibrating plate or a diaphragm to be deformed in accordance with deformation of each active portion of the piezoelectric layer 41 sandwiched by each individual electrode 35 and the common electrode 34 when an external electric field is applied to the active portion.

Each of the piezoelectric layers 41 to 43 is formed into a continuous flat plate having its size and shape to cover one ink ejection region. Each actuator unit 20 is positioned over all pressure chambers 10 in the corresponding one pressure chamber group. The individual electrodes 35 can be arranged at a high density on the piezoelectric layer 41 by using, for example, a screen printing technique. Each of the piezoelectric layers 41 to 43 is made of a piezoelectric zirconate titanate (PZT)-base ceramic material having ferroelectricity.

Each individual electrode 35 is formed so that its major part is opposed to the corresponding pressure chamber 10. As shown in FIG. 5B, each individual electrode 35 has a main electrode portion 35*a* formed on the upper face of the piezoelectric layer 41 in a region 37 opposed to the corresponding pressure chamber 10, which region may be referred to as second region. In a plan view, the main electrode portion 35*a* has a substantially rhombic shape substantially similar to the pressure chamber 10.

Further, each individual electrode 35 has an outside electrode portion 35*b* positioned outside the region 37; and a connecting electrode portion 35*c* electrically connecting the outside electrode portion 35*b* to the main electrode portion 35*a*. The outside electrode portion 35*b* is formed in a region 38, which may be referred to as first region, neighboring the region 37 so as to be opposed to an outside region near an acute portion of the corresponding pressure chamber 10. One end of the connecting electrode 35*c* is connected to an acute portion of the main electrode portion 35*a* while the other end of the connecting electrode 35*c* is connected to the outside electrode portion 35*b* positioned in the region 38. As shown in FIG. 5B, opposite acute portions of the main electrode portion 35*a* are distant from each other in a sub scanning direction, and the connecting electrode portion 35*c* extends in the sub scanning direction. In a plan view, regions 38 are distant from each other on the upper face of the piezoelectric layer 41 so as to correspond to the respective pressure chambers 10. Each of the main electrode portion 35*a*, the outside electrode portion 35*b*, and the connecting electrode portion 35*c* has its thickness of about 1 micrometer.

The individual electrodes 35 are arranged in a matrix like the pressure chambers 10 to constitute individual electrode rows 85 arranged in a main scanning direction at regular intervals. Sixteen individual electrode rows 85 are arranged parallel to each other in the sub scanning direction. The acute portions of each main electrode portion 35*a* with the outside electrode portion 35*b* and the connecting electrode portion 35*c* are in between two individual electrodes 35 belonging to the neighboring individual electrode rows 85.

A land 36 is formed on and electrically connected to an end of each outside electrode portion 35*b*. The land 36 serves as a connection terminal with the corresponding FPC 50. The land 36 has a circular profile having its diameter of about 160 micrometers. Each individual electrode 35 is connected through its land 36 to the driver IC 52 provided on the corresponding FPC 50.

An electric field blocking layer 33 is formed on each region 38 of the piezoelectric layer 41 to be sandwiched by the piezoelectric layer 41 and the corresponding outside electrode portion 35*b*. Thus, the electric field blocking layer 33 is sandwiched by the corresponding land 36 and outside electrode portion 35*b* and the piezoelectric layer 41 so as to be opposed to an outside region of the corresponding pressure chamber 10. In other words, each individual electrode 35 is formed to extend from a region opposed to the corresponding pressure chamber 10 to the upper surface of the corresponding electric field blocking layer 33.

Each electric field blocking layer 33 of this embodiment is made of an oxide film obtained by anodizing aluminum as a base material, that is, each layer is made into an alumina film base. Further, the electric field blocking layer 33 has a porous structure in which a plurality of holes 32 are formed to extend from the upper surface to the lower surface. The alumina film as the base material of the electric field blocking layer 33 is lower in dielectric constant than the piezoelectric layer 41. In addition, the holes 32 further lower the effective dielectric constant. In this embodiment, aluminum is used as the base material of each electric field blocking layer 33. In a modification, however, another metal material may be used. In the modification, the obtained oxide film is preferably lower in dielectric constant than the piezoelectric layer 41. Formation of one or more holes 32 in such a base material further lowers the dielectric constant.

Each electric field blocking layer 33 is opposed to the whole of the corresponding land 36 and outside electrode portion 35*b*. The electric field blocking layer 33 has expanded portions 33*a* and 33*b* expanded from the opposing portion in directions in which the distances T to other individual electrodes 35 neighboring the land 36 are shortest, that is, substantially vertically in FIG. 5B. The expanded portions 33*a* and 33*b* are expanded so as not to be opposed to the corresponding pressure chamber 10. The expanded portions 33*a* and 33*b* thus formed in each electric field blocking layer 33 prevents an external electric field from being applied to a portion of the piezoelectric layer 41 opposed to the corresponding land 36 and outside electrode portion 35*b*, from the outside of the portion of the electric field blocking layer 33 opposed to the land 36 and outside electrode portion 35*b*. This suppresses structural crosstalk.

The common electrode 34 has substantially the same size as the piezoelectric layer 41 to cover all pressure chambers 10 belonging to one pressure chamber group 9. Thus, the common electrode 34 is opposed to all individual electrodes 35, lands 36, and electric field blocking layers 33 formed in one actuator unit. The common electrode 34 is grounded in a not-shown region. Thus, the common electrode 34 is kept at a ground potential evenly in the region corresponding to all pressure chambers 10. The potentials of the individual electrodes 35 can be controlled independently for each pressure chamber 10. As for the materials of the electrodes, for example, each land 36 is made of gold containing glass frit, and each of the individual electrodes 35 and common electrode 34 is made of a metallic material such as an Ag—Pd-base alloy.

A portion of each actuator unit 20 where each individual electrode 35 is disposed serves as a pressure generating portion to apply pressure to ink in the corresponding pressure chamber 10. Thus, each actuator unit 20 has a so-called unimorph type structure in which only the outermost piezoelectric layer 41 includes active portions where piezoelectric strain is generated due to an external electric field, and the remaining two piezoelectric layers 42 and 43 are inactive layers. In another respect, each actuator unit 20 has a plurality of actuators each of which is constituted by an individual electrode 35 and portions of the piezoelectric layers 41 to 43 and common electrode 34 opposed to the individual electrode 35.

Next, an operation of each actuator unit 20 will be described. In each actuator unit 20, only the piezoelectric layer 41 of the three piezoelectric layers 41 to 43 has been polarized in the direction from each individual electrode 35 toward the common electrode 34, that is, in a direction in which the individual electrode 35, the piezoelectric layer 41, and the common electrode 34 are put in layers, and along the thickness of the piezoelectric layer 41. When a drive signal is given to an individual electrode 35 via the corresponding FPC 50 to put the individual electrode 35 at a predetermined positive potential, an external electric field is applied to the corresponding active portion along its thickness. As a result, the active portion is shrunk perpendicularly to the polarization by the transversal piezoelectric effect. The other piezoelectric layers 42 and 43 are not shrunk in themselves because no external electric field is applied. They serve as a constraining layer to the active portion. As a result, the whole of the active portion of the piezoelectric layer 41 and portions of the piezoelectric layers 42 and 43 opposed to the active portion are deformed convexly toward the corresponding pressure chamber 10, which is unimorph deformation. This reduces the volume of the pressure chamber 10 to increase the pressure of ink in the pressure chamber 10. As a result, ink is ejected from the corresponding ejection port 8 as shown in FIG. 4. Afterward, when the individual electrode 35 is put back to the ground potential, the piezoelectric layers 41 to 43 are restored to their original shapes, and the pressure chamber 10 is also restored to its original volume. As a result, ink is sucked from the corresponding sub manifold channel 5*a* into the corresponding individual ink passage 32.

In another driving method, each individual electrode 35 is put at a positive potential in advance. Each time when an ejection request is received, the target individual electrode 35 is once put at the ground potential. Afterward, the individual electrode is again put at the positive potential at a predetermined timing. In this method, the piezoelectric layers 41 to 43 are restored to their original shapes at the timing when the individual electrode 35 is put at the ground potential. This increases the volume of the corresponding pressure chamber 10 from its initial volume, that is, the volume when the individual electrode 35 is at the positive potential. As a result, ink is sucked from the corresponding sub manifold channel 5*a* into the corresponding individual ink passage 32. Afterward, at the timing when the individual electrode 35 is again put at the positive potential, the whole of the corresponding active portion of the piezoelectric layer 41 and portions of the piezoelectric layers 42 and 43 opposed to the active portion are deformed convexly toward the pressure chamber 10. This reduces the volume of the pressure chamber 10 to increase the pressure of ink in the pressure chamber 10. As a result, ink is ejected from the corresponding ejection port 8.

Next, a manufacturing method of the inkjet head 1 will be described with reference to FIGS. 6 and 7A to 7F. To manufacture the inkjet head 1, parts such as a passage unit 4 and actuator units 20 are separately fabricated, and then the parts are assembled.

Figure 6:
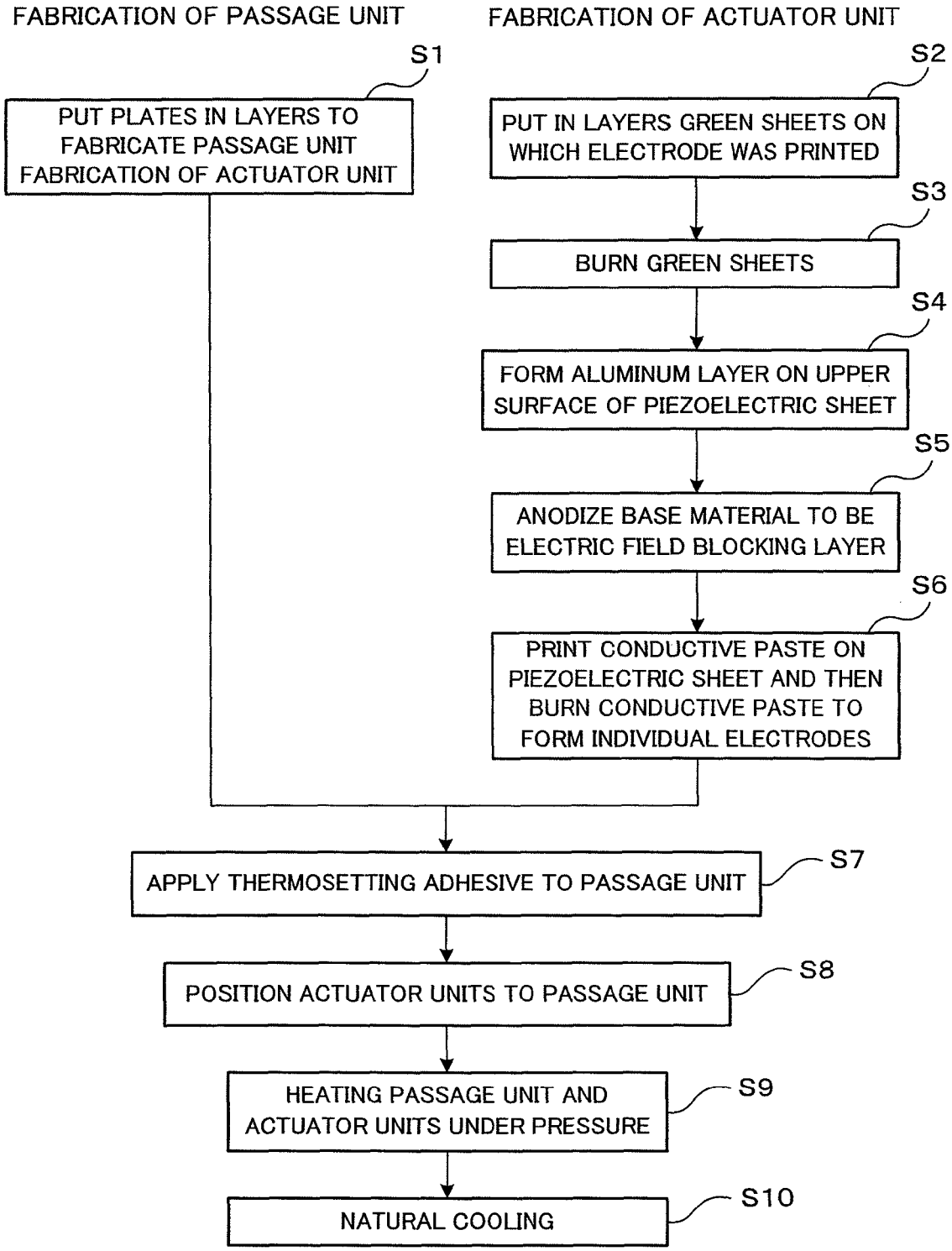
FIG. 6 is a flowchart of a manufacturing process of the inkjet head according to the first embodiment of the present invention.

As shown in FIG. 6, in Step S1, a passage unit 4 is fabricated. To fabricate the passage unit 4, of the plates 22 to 30 to constitute the passage unit 4, the plates 22 to 29 other than the nozzle plate 30 are etched with the use of patterned photoresists as masks to form holes as shown in FIG. 4 in the respective plates 22 to 29. In the nozzle plate 30, a plurality of holes to serve as nozzles are formed by punching. The nine plates 22 to 30 are positioned to each other so that each pressure chamber 10 is connected to the corresponding ejection port 8 to form an individual ink passage 31. In this state, the plates 22 to 30 are put in layers with an epoxy-base thermosetting adhesive being interposed between them. The nine plates 22 to 30 are then heated under pressure to a temperature more than the cure temperature of the thermosetting adhesive. Thereby, the thermosetting adhesive is cured to fix the nine plates 22 to 30 to each other. A passage unit 4 as shown in FIG. 4 is thus obtained.

Figure 7A:
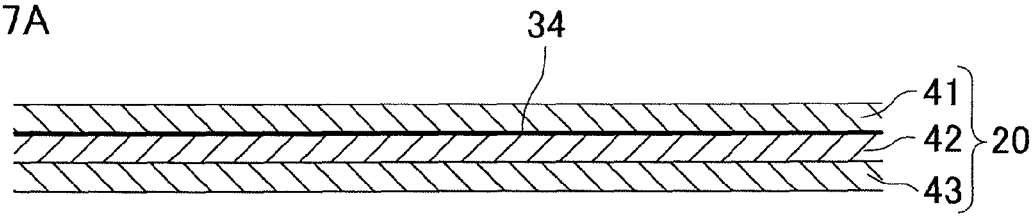
FIGS. 7A to 7F are partial sectional views of an actuator unit of the inkjet head according to the first embodiment of the present invention in the order of its manufacturing steps.

On the other hand, to fabricate an actuator unit 20, first, in Step S2, three green sheets made of piezoelectric ceramic are prepared. Each green sheet is formed with taking into consideration in advance shrinkage by burning. Conductive paste is screen-printed on a surface of one green sheet in the pattern of the common electrode 34. The three green sheets are positioned to each other with the use of a jig, and in this state, they are put in layers so that non-printed two green sheets vertically sandwich the printed green sheet, as shown in FIG. 7A.

In Step S3, the layered structure obtained in Step S2 is degreased like known ceramics, and then burned at a predetermined temperature. Thereby, three green sheets become piezoelectric layers 41 to 43, and the conductive paste becomes a common electrode 34. This step is referred to as common electrode forming step.

Figure 7B:
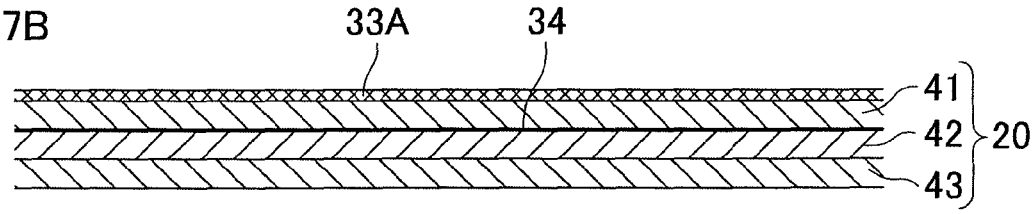

In Step S4, as shown in FIG. 7B, an aluminum layer as the base material 33A of the electric field blocking layers 33 is formed on the whole of the upper surface of the uppermost piezoelectric layer 41 by a vapor deposition process, for example, sputtering. This step is referred to as base material forming step.

Figure 7C:
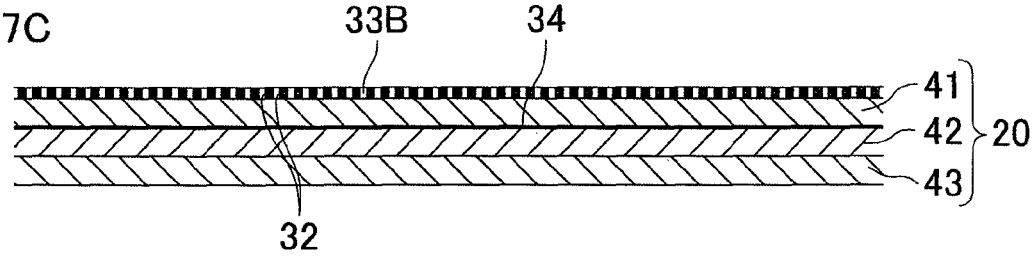
Figure 7D:
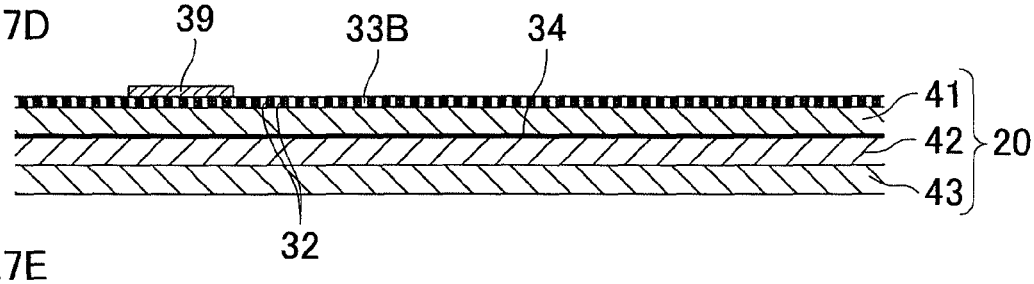

In Step S5, the layered structure on which the base material 33A was formed in Step S4 is dipped in acidic electrolyte to anodize the surface of the base material 33A, which is referred to as anodizing step. Thereby, as shown in FIG. 7C, the base material 33A is oxidized, and a plurality of holes 32 are formed so as to extend from the upper surface of the base material 33A toward the piezoelectric layer 41. The opening diameter of each hole 32 is several hundreds nanometers. Further, as shown in FIG. 7D, a resist layer 39 having a pattern of each electric field blocking layer 33 is formed on the oxidized base material 33A, that is, the anodized film 33B. The resist layer 39 is formed by photolithography including drying, exposure, and development of the resist applied on the anodized film 33*b* as the base material. At this time, each resist layer 39 is formed so as to be opposed to the whole of the corresponding land 36 and outside electrode portion 35*b*, which will be described later. In addition, each resist layer 39 of this embodiment is expanded in directions in which the distances T to other individual electrodes 35 neighboring the land 36 are shortest. The expanded portions of the resist layer 39 correspond to the expanded portions 33*a* and 33*b* of the electric field blocking layer 33.

Figure 7E:
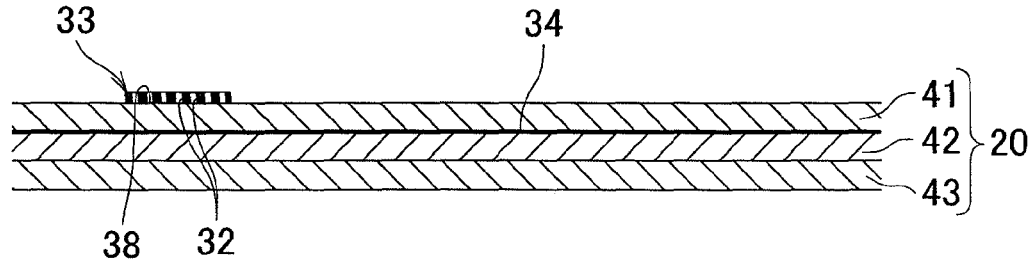

Afterward, the anodized film 33*b* is etched in acid solution to leave the portion covered with each resist layers 39. Each resist layer 39 on the remaining portion of the anodized film 33*b* is then peeled off. As shown in FIG. 7E, each electric field blocking layer 33 is thus formed on the piezoelectric layer 41, which is referred to as electric field blocking layer forming step. Each electric field blocking layer 33 has a portion to be opposed to the corresponding land 36 and outside electrode portion 35*b*, and further has expanded portions 33*a* and 33*b* expanded outside from the above portion.

In this embodiment, each hole 32 formed in the upper surface of each electric field blocking layer 33 has a very small opening diameter. Therefore, when conductive paste is applied to the upper surface of each electric field blocking layer 33 in Step S6 as will be described later, the conductive paste scarcely enters each hole 32. Thus, the portion of the conductive paste to be each outside electrode portion 35*b* can be formed into a desired shape without distortion.

Figure 7F:
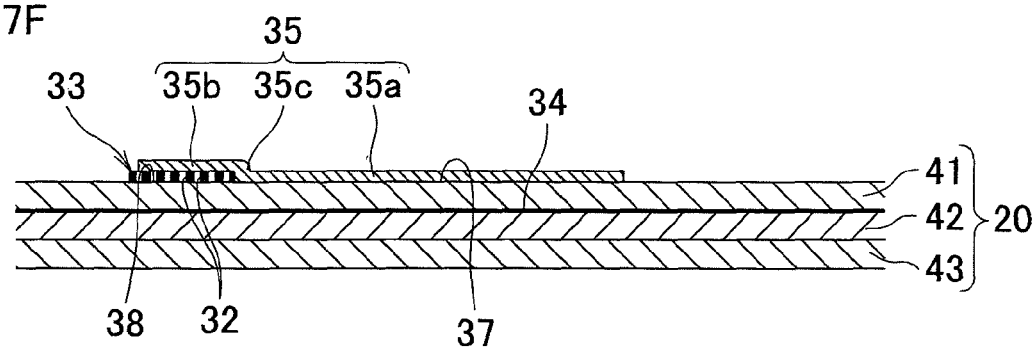

Next, in Step S6, as shown in FIG. 7F, a conductive paste is screen-printed in the pattern of each individual electrode 35. As also shown in FIG. 5A, the portion of the conductive paste to be the outside electrode portion 35*b* is disposed on the upper surface of the electric field blocking layer 33, that is, in the region 38; the portion of the conductive paste to be the main electrode portion 35*a* is positioned in the region 37; and the portion of the conductive paste to be the connecting electrode portion 35*c* is disposed as a bridge between the regions 37 and 38. The layered structure is then heated to burn the conductive paste. Each individual electrode 35 is thus formed on the piezoelectric layer 41. This step is referred to as individual electrode forming step.

Afterward, gold containing glass frit is printed on each outside electrode portion 35*b* to form a land 36, which is referred to as land forming step. At this time, because the land 36 is formed on the corresponding individual electrode 35 obtained by burning the conductive paste, a raw material of a low formation temperature can be selected for the land 36. This expands the scope of selection of the material of the land 36. An actuator unit 20 as shown in FIGS. 5A and 5G is thus fabricated. Because three piezoelectric layers 41 to 43 do not shrink in burning for forming the individual electrodes 35, each individual electrode 35 can surely be formed at a position to be opposed to the corresponding pressure chamber 10.

The process for fabricating the passage unit in Step S1 and the process for fabricating the actuator unit in Steps S2 to S6 are performed independently of each other. Therefore, any of them may be performed first, or they may be performed in parallel.

Next, in Step S7, a thermosetting adhesive is applied with a bar coater to the upper face of the passage unit 4 obtained in Step S1. In Step S8, actuator units 20 are put on the thermosetting adhesive having been applied to the passage unit 4. At this time, each actuator unit 20 is positioned to the passage unit 4 so that the main electrode portion 35 of each individual electrode 35 is opposed to the corresponding pressure chamber 10 and the outside electrode portion 35*b* of the individual electrode 35 is opposed to an outside region of the pressure chamber 10. This positioning process is performed with the use of not-shown positioning marks formed in advance to the passage unit 4 and each actuator unit 20 in their manufacturing steps, that is, Steps S1 to S6.

In Step S9, the layered structure of the passage unit 4 and the actuator units 20 is heated under pressure to a temperature more than the cure temperature of the thermosetting adhesive in a not-shown heating/pressing apparatus. In Step S10, the layered structure is taken out from the heating/pressing apparatus, and then naturally cooled. A head main body 70 is thus fabricated to be constituted by the passage unit 4 and the actuator units 20.

Afterward, an FPC 50 is bonded to each actuator unit 20, that is, independent signal lines formed on the FPC 50 are bonded to the respectively corresponding lands 36 of the actuator unit 20. A reservoir unit 71 is then bonded, and a cover member 58 is attached. An inkjet head 1 as described above is thus completed.

In the above-described embodiment, the base material 33A is directly anodized. In a modification, however, the base material 33A may be anodized after being etched into the pattern of the electric field blocking layers with the use of photolithography. Further, in the above-described embodiment, the base material 33A is formed by vapor deposition. In a modification, however, a paste made of a metallic material that can be anodized may be applied in a predetermined pattern. In this modification, there is no necessity of the process of forming the resist layer 39 on the anodized film 33B and then etching the anodized film 33B as in the above-described embodiment.

In the above-described embodiment, the porous electric field blocking layers 33 each having one or more holes 32 are interposed between the lands 36 and the piezoelectric layer 41. Thus, when lands 36 and the corresponding individual electrodes 35 and the common electrode 34 are put at predetermined potentials, an external electric field is hard to be applied to the portion of the piezoelectric layer 41 opposed to each land 36. Therefore, the portion of the piezoelectric layer 41 is hard to be deformed. This suppresses so-called structural crosstalk in which the deformation of the portion of the piezoelectric layer 41 spreads around the portion. As a result, ink ejection characteristics become stable. In addition, because each electric field blocking layer 33 is a porous layer having one or more holes 32, its dielectric constant is considerably lower than that of the piezoelectric layer 41. This expands the scope of selection of the raw material of the base material of the electric field blocking layer 33.

In the above-described embodiment, each electric field blocking layer 33 is disposed so as to be opposed to the whole of the corresponding outside electrode portion 35*b*. Thus, when an individual electrode 35 and the common electrode 34 are put at predetermined potentials, an external electric filed is hard to be applied to the portion of the piezoelectric layer 41 opposed to the corresponding outside electrode portion 35*b*. Therefore, the portion of the piezoelectric layer 41 is hard to be deformed. This more suppresses the structural crosstalk. As a result, the ink ejection characteristics become more stable. In addition, because the base material itself to be each electric field blocking layer 33 is lower in dielectric constant than the piezoelectric layer 41, the dielectric constant of the electric field blocking layer 33 is lower.

Further, in the above-described embodiment, each electric field blocking layer 33 has the expanded portions 33*a* and 33*b* expanded toward other individual electrodes 35. These expanded portions 33*a* and 33*b* prevent an external electric field from influencing from the outside of the region opposed to the corresponding land 36 and outside electrode portion 35*b*. This further suppresses unnecessary structural crosstalk.

Figure 8:
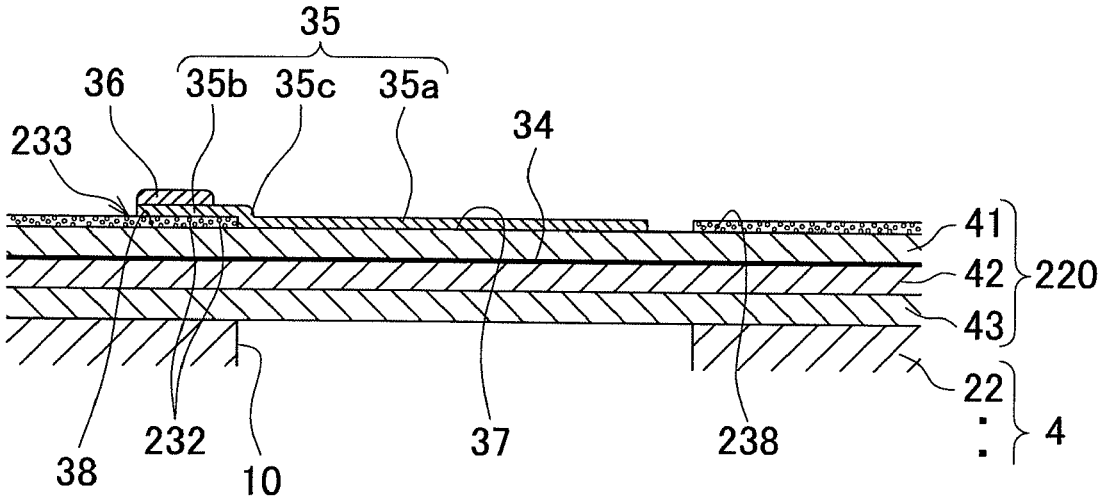
FIG. 8 is a partial sectional view of an actuator unit according to a second embodiment of the present invention.

Next, an actuator unit 220 according to a second embodiment of the present invention will be described with reference to FIG. 8. In this second embodiment, the same components as of the above-described first embodiment are respectively denoted by the same reference numerals as in the above-described first embodiment to omit the description thereof.

The actuator unit 220 of this embodiment includes an electric field blocking layer 233 different in construction from the electric field blocking layers 33 of the first embodiment. Other than that feature, the actuator unit 220 of this embodiment has substantially the same construction as the actuator unit 20 of the first embodiment. Differently from the electric field blocking layers 33 of the first embodiment that are formed on the upper surface of the piezoelectric layer 41 separately for the respective pressure chambers 10, the electric field blocking layer 233 of the actuator unit 220 is formed in the whole region outside the regions 37 opposed to the respective pressure chambers 10. The region outside the regions 37 also includes the regions 38.

The electric field blocking layer 233 also has therein a plurality of holes 232. These holes 232 are formed in an alumina layer to be the electric field blocking layer 233, in the manner that very small resin chips 231 dispersed in an alumina paste are melted and evaporated in burning the paste layer as a base material. Therefore, the holes 232 are formed in the electric field blocking layer 233 to be disposed at random.

Because the electric field blocking layer 233 is formed substantially over the whole area on the piezoelectric layer 41, the piezoelectric layer 41 is prevented from receiving external electric fields from lands 36 and outside electrode portions 35*b* when the lands 36 and the corresponding individual electrodes 35 and the common electrode 34 are put at predetermined potentials. This more suppresses the structural crosstalk. In addition, because the electric field blocking layer 233 enhances the rigidity of the region of the piezoelectric layer 41 outside the regions 37, this suppresses deformation of the portions of the piezoelectric layer 41 opposed to the outside regions of the respective pressure chambers 10.

Next, a manufacturing method of the actuator unit 220 will be described with reference to FIGS. 9 and 10A to 10C.

Figure 9:
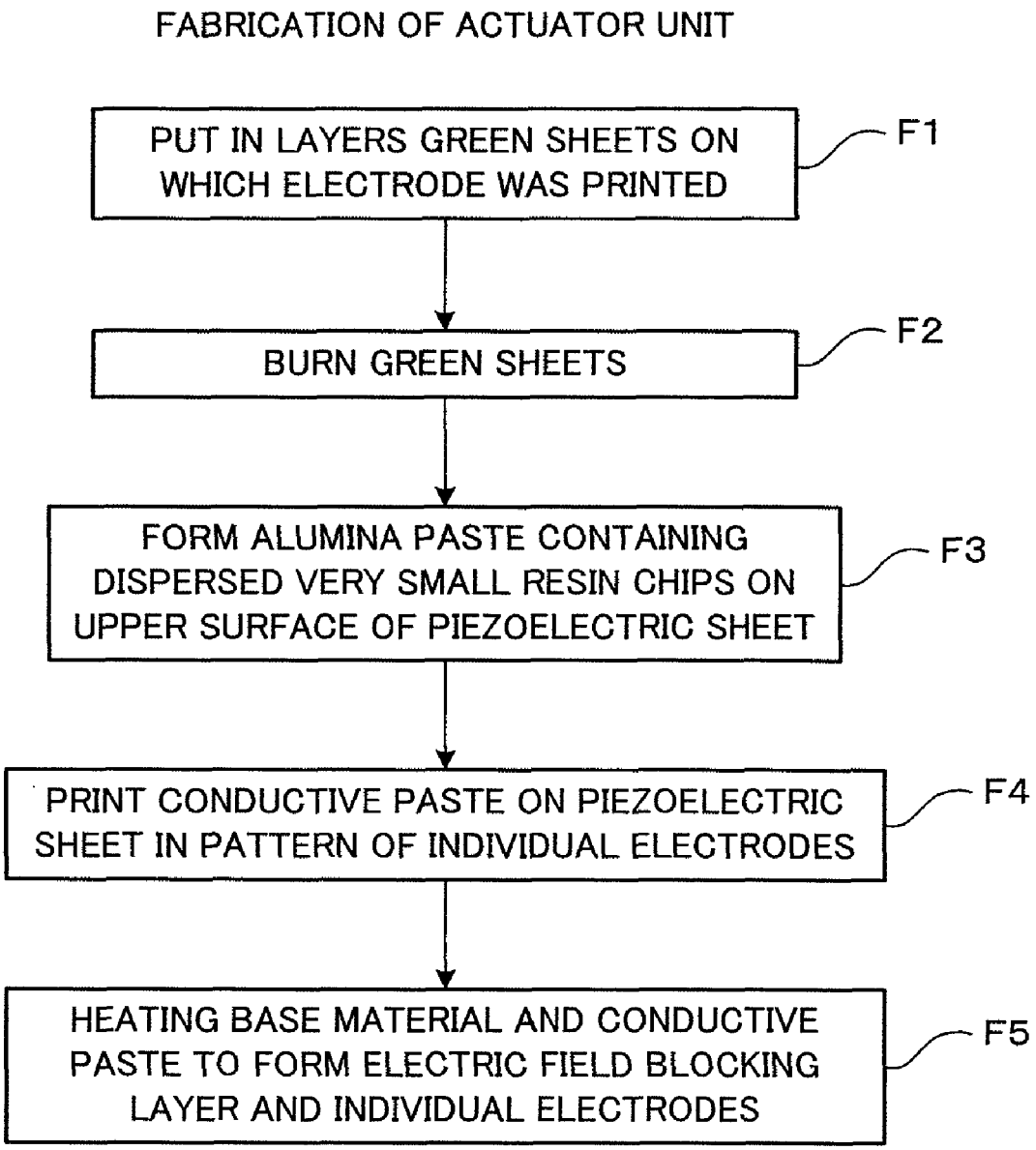
FIG. 9 is a flowchart of a manufacturing process of the actuator unit according to the second embodiment of the present invention.
Figure 10A:
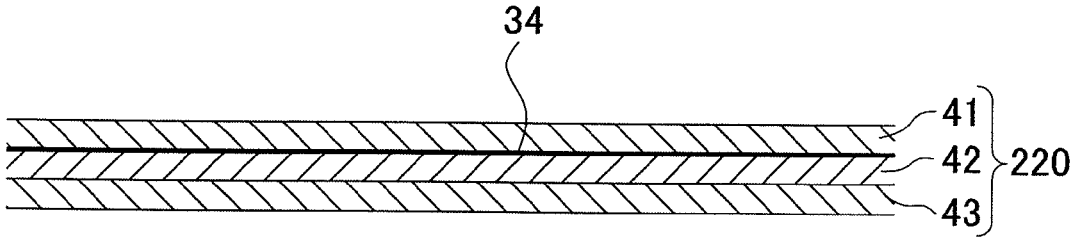
FIGS. 10A to 10C are partial sectional views of the actuator unit according to the second embodiment of the present invention in the order of its manufacturing steps.

To fabricate the actuator unit 220 of this embodiment, as shown in FIG. 9, Steps F1 and F2 are performed that are the same as Steps S2 and S3 in the manufacturing process of the actuator unit 20 of the first embodiment. Thereby, as shown in FIG. 10A, a layered structure is formed in which three piezoelectric layers 41 to 43 are put in layers in this order, and a common electrode 34 is formed between two piezoelectric layers 41 and 42, which is referred to as common electrode forming step.

Figure 10B:
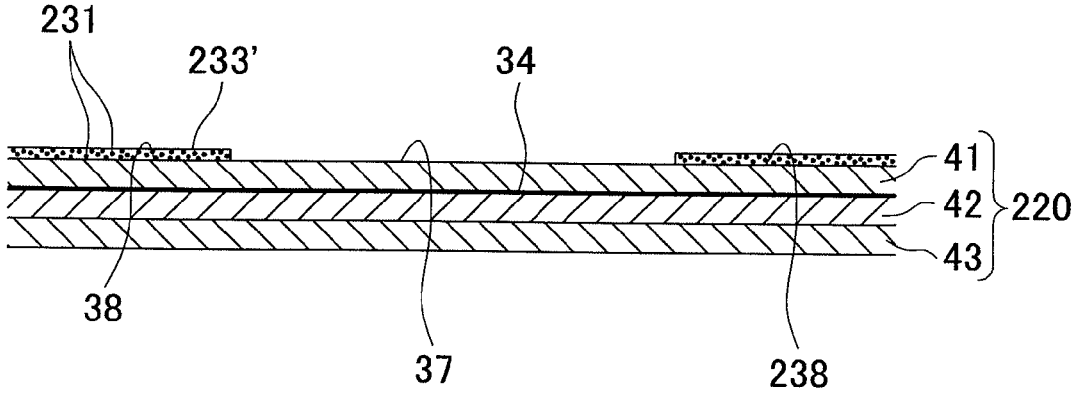

Next, in Step F3, as shown in FIG. 10B, an alumina paste 233' as a base material is formed in the pattern of the electric field blocking layer 233 by screen printing or the like on the upper surface of the uppermost piezoelectric layer 41 over the whole of the outside of the regions 37. As will be described later, the alumina paste 233' becomes the electric field blocking layer 233 by burning, and very small resin chips 231 have been dispersed in the alumina paste 233'. After formation, the alumina paste 233' is dried at a predetermined temperature to remove an unnecessary organic solvent from the paste. This step is referred to as base material forming step.

Figure 10C:
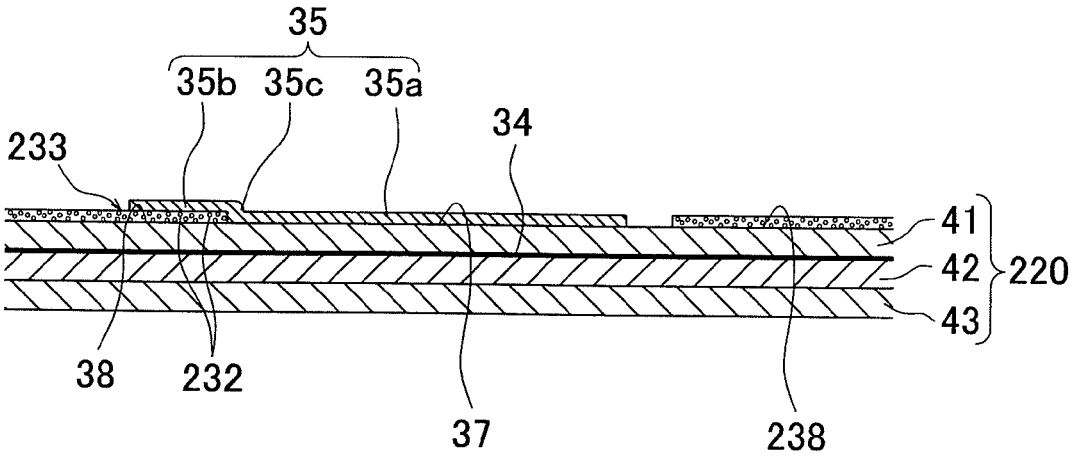

Next, in Step F4, as shown in FIG. 10C, a conductive paste is screen-printed in the pattern of each individual electrode 35. At this time, the portion of the conductive paste to be the outside electrode portion 35*b* is positioned on the upper surface of the electric field blocking layer 233, that is, in the region 38; the portion of the conductive paste to be the main electrode portion 35*a* is positioned in the region 37; and the portion of the conductive paste to be the connecting electrode portion 35*c* is positioned as a bridge between the regions 37 and 38.

Next, in Step F5, the layered structure is heated to melt and evaporate the resin chips 231 in the alumina paste 233', and thereby form a plurality of holes 232 in the electric field blocking layer, that is, an alumina layer as a base material. This process is referred to as heating and electric field blocking layer forming step. At the same time, by heating, the conductive paste is burned to form individual electrodes 35 on the piezoelectric layer 41, which is referred to as individual electrode forming step. At this time, even though the openings of the holes 232 are formed in the upper surface of the electric field blocking layer 233 by melting and evaporating the resin chips 231, the conductive paste does not flow in the holes 232 because the portion of the conductive paste to be the outside electrode portion 35*b* of each individual electrode 35 has started to be solidified. Thus, each outside electrode portion 35*b* can be formed into a desired shape without distortion.

Afterward, gold containing glass frit is printed on the outside electrode portion 35*b* of each individual electrode 35 to form a land 36, which is referred to as land forming step. At this time, because the land 36 is formed on the individual electrode 35 obtained by burning the conductive paste, a raw material of a low formation temperature can be selected for the land 36. This brings about the same effect as of the first embodiment. An actuator unit 220 as shown in FIG. 8 is thus fabricated. Because the piezoelectric layers 41 to 43 do not shrink in burning for forming the individual electrodes 35, each individual electrode 35 can surely be formed at a position to be opposed to the corresponding pressure chamber 10.

In the above-described manufacturing method of the actuator unit 220, by heating the alumina paste 233', which is to be the electric field blocking layer 233, that is, the base material, to form a plurality of holes 232, the conductive paste can be also burned to form the individual electrodes 35. This reduces the number of manufacturing steps in comparison with the manufacturing process of the first embodiment. In addition, because an external electric field is hard to be applied to the whole portion of the piezoelectric layer 41 outside the regions 37, the actuator unit 220 can be obtained in which structural crosstalk has been more suppressed. The same construction as of the first embodiment brings about the same effects as of the first embodiment.

In the actuator unit 20 or 220 of the above-described embodiments, each electric field blocking layer 33 or the electric field blocking layer 233 is formed to be expanded to the outside of each region opposed to a land 36 and an outside electrode portion 35*b*. In a modification, however, such an electric field blocking layer is only required to be opposed to each land 36. In the above-described embodiments, each electric field blocking layer 33 or the electric field blocking layer 233 has a plurality of holes 32 or 232. In a modification, however, such an electric field blocking layer may have only one hole. In the modification, the hole is preferably formed at a position opposed to each land 36 and outside electrode portion 35*b* to be elongated in the upper surface of the piezoelectric layer 41. In another modification, a plurality of elongated holes as described above may be formed. In the above-described embodiments, each land 36 is formed at a position to sandwich the corresponding outside electrode portion 35*b* between the land 36 and the corresponding electric field blocking layer 33 or the electric field blocking layer 233. In a modification, however, each land 36 may directly neighbor the corresponding outside electrode portion 35*b* in the upper surface of the piezoelectric layer 41. That is, each land 36 may not cooperate with the corresponding electric field blocking layer 33 or the electric field blocking layer 233 to sandwich the corresponding outside electrode portion 35*b*. In a modification, the actuator unit 20 or 220 may not have the piezoelectric layer 43 or both of the piezoelectric layers 42 and 43. In a modification, a metal plate made of, for example, stainless steel, may be put on the uppermost plate 22 of the passage unit 4 so as to cover all pressure chambers 10 belonging to at least one pressure chamber group 9 so that the metal plate is used as a vibrating plate. In a modification, the actuator unit 20 or 220 may include a conductive vibrating plate in place of the piezoelectric layers 42 and 43. In the modification, because the vibrating plate can be also used as a common electrode, the common electrode 34 need not particularly be provided.

In the above-described embodiments, by way of example, the present invention is applied to an inkjet head that ejects ink from its ejection ports. However, the objects to which the present invention can be applied are never limited to such inkjet heads. The present invention can be applied to various kinds of liquid ejection heads, for example, for ejecting a conductive paste to form a minute wiring pattern on a substrate; for ejecting an organic luminous liquid onto a substrate to form a high-definition display; or for ejecting an optical resin onto a substrate to form a fine electric device such as an optical waveguide.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An actuator unit to be fixed to a surface of a passage unit in which liquid passages including a plurality of pressure chambers are formed, the actuator unit serving to apply pressure to liquid in each pressure chamber, the actuator unit comprising:

a piezoelectric layer;

a common electrode formed on one surface of the piezoelectric layer so as to be positioned over the plurality of pressure chambers;

a plurality of electric field blocking layers formed on an opposite surface of the piezoelectric layer from the one surface so as to be opposed to the common electrode and outside regions of the respective pressure chambers, the electric field blocking layers being arranged on the opposite surface of the piezoelectric layer so as to be distant from each other in the plane of the opposite surface, each electric field blocking layer having one or more holes, each electric field blocking layer being lower in dielectric constant than the piezoelectric layer;

a plurality of lands each of which is positioned so as to cooperate with the piezoelectric layer to sandwich an electric field blocking layer; and a plurality of individual electrodes formed on the opposite surface of the piezoelectric layer so as to be opposed to the respective pressure chambers and the common electrode and neighbor the respective electric field blocking layers, each individual electrode being electrically connected to the corresponding land.

2. The actuator unit according to claim 1, wherein each individual electrode extends from a region opposed to the corresponding pressure chamber to a surface of the corresponding electric field blocking layer, and each electric field blocking layer is opposed to the whole of a portion of the corresponding individual electrode opposed to the outside region of the corresponding pressure chamber.

3. The actuator unit according to claim 2, wherein each individual electrode is sandwiched between the corresponding land and the corresponding electric field blocking layer.

4. The actuator unit according to claim 3, wherein each electric field blocking layer is expanded to the outside of a region of the piezoelectric layer opposed to the corresponding land, and the outside of the portion of the corresponding individual electrode opposed to the outside region of the corresponding pressure chamber.

5. The actuator unit according to claim 4, wherein the plurality of electric field blocking layers are connected to each other so as to cover the whole of the outside of the regions of the piezoelectric layer opposed to the respective pressure chambers.

6. The actuator unit according to claim 1, wherein a base material of each electric field blocking layer is made of a material lower in dielectric constant than the piezoelectric layer.

7. A manufacturing method of an actuator unit to be fixed to a surface of a passage unit in which liquid passages including a plurality of pressure chambers are formed, the actuator unit serving to apply pressure to liquid in each pressure chamber, the method comprising:

a common electrode forming step of forming a common electrode on one surface of a piezoelectric layer, the common electrode having its size capable of covering the plurality of pressure chambers;

an electric field blocking layer forming step of forming a plurality of electric field blocking layers respectively in a plurality of first regions on an opposite surface of the piezoelectric layer from the one surface, the first regions being opposed to the common electrode, the first regions being arranged on the opposite surface of the piezoelectric layer so as to be distant from each other in the plane of the opposite surface, each electric field blocking layer having one or more holes, each electric field blocking layer being lower in dielectric constant than the piezoelectric layer;

an individual electrode forming step of forming a plurality of individual electrodes respectively in a plurality of second regions on the opposite surface of the piezoelectric layer, the second regions being opposed to the common electrode and neighboring the respective electric field blocking layers, each individual electrode being further formed on a surface of the electric field blocking layer neighboring the corresponding second region; and a land forming step of forming a plurality of lands in regions of the respective individual electrodes opposed to the respective electric field blocking layers.

8. The method according to claim 7, wherein the electric field blocking layer forming step comprises:

a base material forming step of forming a base material of the electric field blocking layers in the plurality of first regions; and an anodizing step of anodizing a surface of the base material after the base material forming step to form the one or more holes in the surface of the base material.

9. The method according to claim 8, wherein the base material is formed in the base material forming step in the whole of the outside of the second regions.

10. The method according to claim 7, wherein the electric field blocking layer forming step comprises:

a base material forming step of forming in the plurality of first regions a base material of the electric field blocking layers in which a plurality of very small resin chips have been dispersed; and a heating step of heating the base material after the base material forming step to a temperature at which the plurality of resin chips are melted and evaporated to form the one or more holes in the base material.

11. A liquid ejection head comprising a passage unit in which a plurality of pressure chambers each connected to an ejection port are arranged adjacent to each other in a matrix along a surface of the passage unit; and an actuator unit fixed to the surface of the passage unit for changing the volume of each pressure chamber, the actuator unit having a layered structure in which a common electrode positioned over the plurality of pressure chambers, a piezoelectric layer capable of expanding and contracting by an externally applied electric field, and a plurality of individual electrodes positioned so as to be opposed to the respective pressure chambers are put in layers in this order on a vibrating plate that covers the plurality of pressure chambers, the piezoelectric layer having been polarized along its thickness and being able to expand or contract perpendicularly to its thickness to change the volumes of pressure chambers when an external electric field is applied along its thickness, each individual electrode having on an upper surface of the piezoelectric layer a main electrode portion opposed to the corresponding pressure chamber, and an outside electrode portion opposed to an outside region of the pressure chamber, both of the main and outside electrode portions being opposed to the common electrode, a plurality of electric field blocking layers lower in dielectric constant than the piezoelectric layer being positioned on the upper surface of the piezoelectric layer so as to be opposed the outside regions of the respective pressure chambers and the common electrode, the electric field blocking layers being sandwiched between the piezoelectric layer and a plurality of lands that are electrically connected to the outside electrode portions of the respective individual electrodes so that drive signals can be supplied to the respective individual electrodes through the lands, each electric field blocking layer being a porous layer having therein at least one hole.

12. The head according to claim 11, wherein each electric field blocking layer is opposed to the whole of the outside electrode portion of the corresponding individual electrode.

13. The head according to claim 12, wherein each of the plurality of pressure chambers has a quadrangular profile whose corners are rounded, the main electrode portion of each individual electrode has a profile similar to each pressure chamber, the plurality of individual electrodes constitute a plurality of electrode rows extending in one direction parallel to each other, and a corner of the main electrode portion of each individual electrode is positioned in between two individual electrodes belonging to neighboring electrode rows, the outside electrode portion of each individual electrode and the corresponding land are positioned so as to be connected to the main electrode portion of the individual electrode from a direction intersecting with the one direction, and each electric field blocking layer has an expanded portion that covers a region of the upper surface of the piezoelectric layer opposed to the corresponding land, and is expanded from the region of the upper surface of the piezoelectric layer opposed to the land toward an individual electrode neighboring the land in a direction in which the distance to the neighboring individual electrode is the smallest.

14. The head according to claim 11, wherein the outside electrode portion of each individual electrode and the corresponding land are put in layers in this order on the upper surface of the corresponding electric field blocking layer, and a base material of each electric field blocking layer is lower in dielectric constant than the piezoelectric layer.

* * * * *